US005157304A

United States Patent [19]

Kane et al.

[11] Patent Number: 5,157,304

[45] Date of Patent: Oct. 20, 1992

[54] FIELD EMISSION DEVICE DISPLAY WITH VACUUM SEAL

[75] Inventors: Robert C. Kane, Woodstock, Ill.; James E. Jaskie, Scottsdale, Ariz.; Norman W. Parker, Wheaton, Ill.

[73] Assignee: Motorola, Inc., Schaumburg, Ill.

[21] Appl. No.: 628,754

[22] Filed: Dec. 17, 1990

[51] Int. Cl.[5] ..... H01J 1/62

[52] U.S. Cl. ..... 313/495; 220/2.1 R

[58] Field of Search ..... 313/495; 156/89; 65/42, 65/43, 152, 155, 58; 220/2.1 R

[56] References Cited

U.S. PATENT DOCUMENTS 3,930,823 1/1976 Kurtz et al. ..... 65/43
4,459,166 7/1984 Dietz et al. ..... 156/89
5,015,912 5/1991 Spindt et al. ..... 313/495

*Primary Examiner*—Donald J. Yusko
*Assistant Examiner*—Nimesh Patel
*Attorney, Agent, or Firm*—Eugene A. Parsons

[57] ABSTRACT

A field emission display constructed from field emission devices, (which are typically fabricated on silicon substrates but which are difficult to seal to pressure levels below $1\times10^{-6}$ Torr because they are fabricated on silicon), can be enclosed in an evacuated volume, sealed using a glass frit, when an appropriate interface layer is first formed on the substrate for the field emission devices.

9 Claims, 3 Drawing Sheets

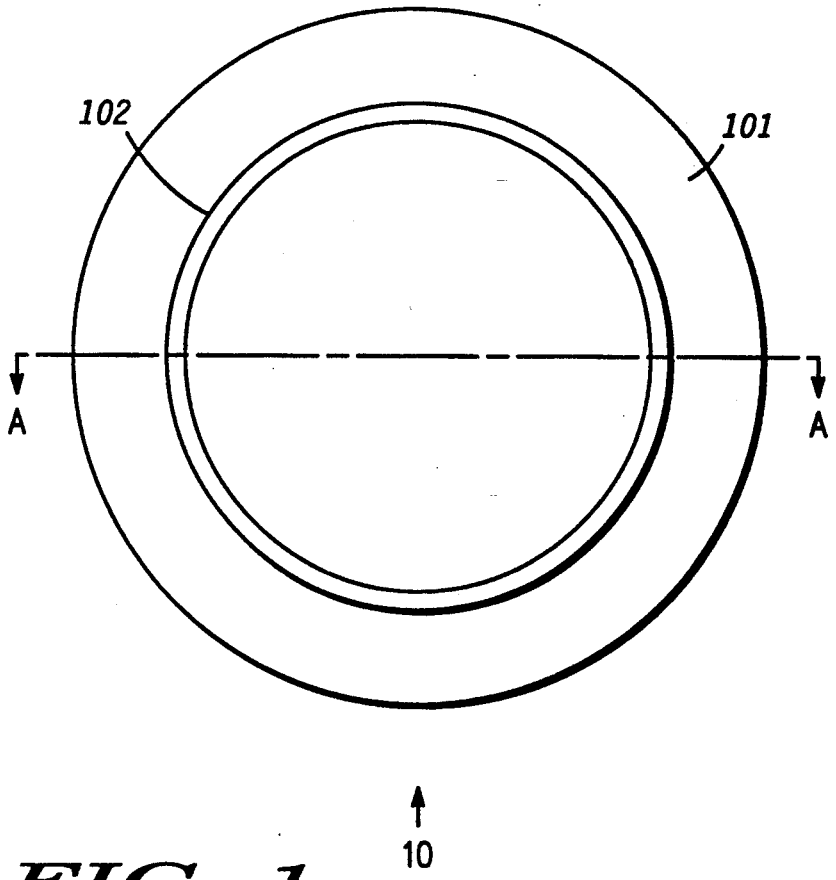
FIG. 1
FIG. 2
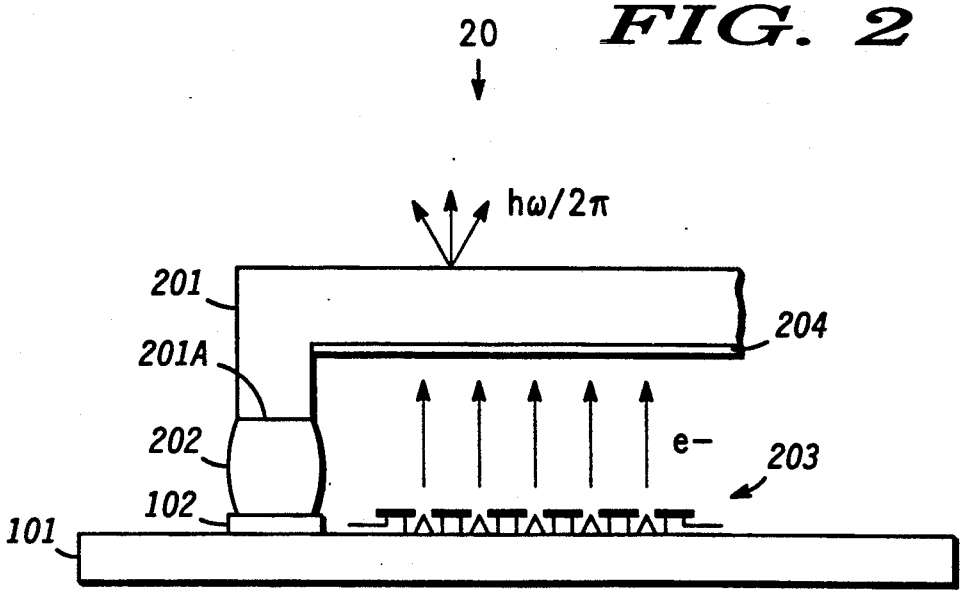

30

40

FIELD EMISSION DEVICE DISPLAY WITH VACUUM SEAL

FIELD OF THE INVENTION

This invention relates to field emission devices (FEDs) used as displays. In particular, this invention relates to FEDs and methods to maintain a high-vacuum seal around FEDs used in a display device.

BACKGROUND OF THE INVENTION

It is well known that field emission devices (FEDs) might be used to display images similar to the images displayed on CRTs. It is also known that to display an image using an FED that the volume surrounding the FED might have to be evacuated to permit emitted electrons to freely travel through the volume surrounding the FED and impinge upon an image faceplate or other surface that can generate visible light. An enclosure for an FED imaging device or a field emission display device should permit the FED to be hermetically sealed in an evacuated volume at very high vacuum levels.

Many prior art vacuum sealing techniques employ epoxies or glass frits to effect a desired vacuum seal between a housing and a housing cover. Epoxy seals are not well-suited to sealing applications requiring vacuum levels, or residual pressure, as low as $1\times10^{-6}$ Torr. because the epoxy may leak or outgas into the evacuated volume. Glass frits do not outgas to the extent that epoxies do and are known to withstand very high vacuum levels but glass frits do not bond well to many materials, including silicon upon which many field emission device displays are fabricated, making glass frit unsuitable as a sealing material in combination with most field emission display substrate materials.

Since FEDs, used in field emission displays operate in very high vacuum environments, typically less than $1\times10^{-6}$ Torr, there exists a need for a new display package and package sealing method that overcome at least some of the shortcomings of the prior art.

SUMMARY OF THE INVENTION

There is disclosed herein a new field emission device display (hereafter a field emission display) package and a method of sealing a field emission display package that overcome at least some of the shortcomings of the prior art. A field emission display, comprised of a supporting substrate having at least one major surface on a part of which resides an electric field induced electron emission structure also includes a preferentially patterned interface layer to which a sealing material may bond. A display faceplate that encloses the field emission display and that defines an enclosed volume to be hermetically sealed and upon which images are produced by a field emission device or structure is distally disposed with respect to the electron emitting structure. The display faceplate includes at least one sealing surface or edge that substantially conforms to the shape of and mates with the patterned interface layer. An appropriate sealing material that strongly bonds to the display faceplate is deposited onto the interface layer between the preferentially patterned interface layer and the sealing surface part of the display faceplate.

The preferentially patterned interface layer is comprised of a material, such as for example silicon dioxide that strongly bonds to the supporting substrate and to the appropriate sealing material disposed between the preferentially patterned interface layer and the display faceplate, which sealing material may be for example a glass frit.

The method for forming an improved high vacuum seal for a field emission display that can sustain a vacuum, or residual pressure, exceeding $1\times10^{-7}$ Torr while providing an adequate bond between the supporting substrate material and a faceplate for the FEDs used in a field emission display includes the steps of providing a semiconductor supporting substrate material having at least one major surface onto which an electric field induced electron emission structure has been formed. The field emission structure is preferable disposed on a part of the major surface of the supporting substrate. The substrate includes an interface layer deposited onto or thermally grown from a predetermined portion of the substrate in a predetermined pattern. A sealing material, such as glass frit, for example, is deposited between the preferentially patterned interface layer and a display faceplate cover for the field emission display devices. The display faceplate cover is distally disposed with respect to the electron emission structure (located at some distance away from the field electron structures).

BRIEF DESCRIPTION OF THE DRAWINGS

FIG. 1 is a top plan view of a field emission display supporting substrate on which is disposed a preferentially patterned interface layer.

FIG. 2 is a partial side elevation cross-sectional depiction of a first embodiment of a field emission display in accordance with the present invention.

DESCRIPTION OF A PREFERRED EMBODIMENT

Figure 3A:
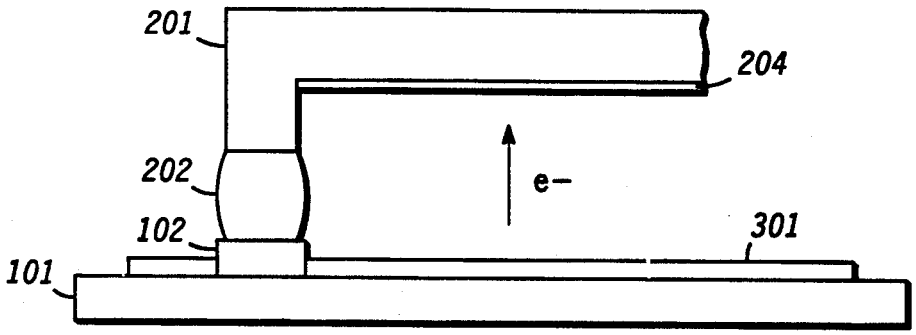
FIGS. 3A and 3B are partial side elevation cross-sectional views corresponding to a second embodiment of a field emission display in accordance with the present invention.

FIG. 1 shows a top view (10) of a supporting substrate (101) having a substantially planar surface. The substrate (101) includes a preferentially patterned interface layer (102) such as, for example, silicon dioxide. This interface layer (102) shown in FIG. 1 covers a substantially annular-shaped area on the substrate (101) that correspond to and mates with an annular-shaped sealing surface of a cover or lid, which encloses a volume of space that is to be evacuated and that extends over the area of the substrate (101) enclosed by the annular-shaped interface layer (102).

The interface layer (102) material preferably has physical properties such that it can strongly bond with, or adhere to, the surface of the supporting substrate (101) as well as the sealing material to be disposed in the intervening region between the interface layer and the cover. Silicon dioxide is a material that can form an acceptable bond to silicon substrate material.

The patterned interface layer (102) may be deposited by a process wherein an oxide layer is deposited on the supporting substrate (101) material and subsequently patterned or wherein an oxide layer is selectively thermally grown from the supporting substrate (101) material.

FIG. 2 shows a partial cross-sectional view of FIG. 1 taken along section line A—A of FIG. 1 and depicts in greater detail portions of one embodiment of a field emission display (20). The features of a field emission display that are shown in FIG. 2 are a supporting substrate (101), a patterned interface layer (102), as described above, an electric field induced electron emission structure (203), and a display faceplate cover (201). The display faceplate cover (201) includes a cathodoluminescent material (204) on its inner surface. The display faceplate cover (201) with the included cathodoluminescent material layer (204) is distally disposed with respect to the electron emission structure, the purpose of the electron emitting structure being to emit electrons, at least some of which will impinge upon the cathodoluminescent material, such that at least some of the energy of the emitted electrons is converted to photon energy as visible light.

A glass frit (202) material is deposited between the patterned interface layer (102) and a sealing portion (201A) of the display faceplate such that it contacts both the sealing portion (201A) and the interface layer (102). The sealing portion (201A) substantially conforms to the shape of the patterned interface layer (102). Glass frit is generally an amorphous material which may have silicon dioxide, $SiO_2$, as a principal component with other materials such as lead, boron, or bismuth added to provide desired physical characteristics such as thermal conductivity and tensile strength.

FIG. 3A shows a partial cross-sectional view of a second embodiment of a field emission display (30) comprised of a supporting substrate (101), a display faceplate, (201) including a cathodoluminescent layer (204) on at least one surface of the faceplate (201), a preferentially patterned interface layer (102), and a glass frit (202). The embodiment shown in FIG. 3A further includes a side view of one conductive line of a plurality of parallel conductive lines (301) on the surface of the substrate (101). The conductive lines (301) operably connect the enclosed FED structure to external circuitry that might be necessary to power or energize the display.

The interface layer (102) can be realized by any of the methods described above as well as other appropriate methods such as, for example, selective etching by which the interface layer (102) can be fabricated to provide one or more regions through which conductive lines (301) can extend. Alternatively, the interface layer (102) may be deposited on or over the conductive lines (301).

Figure 3B:
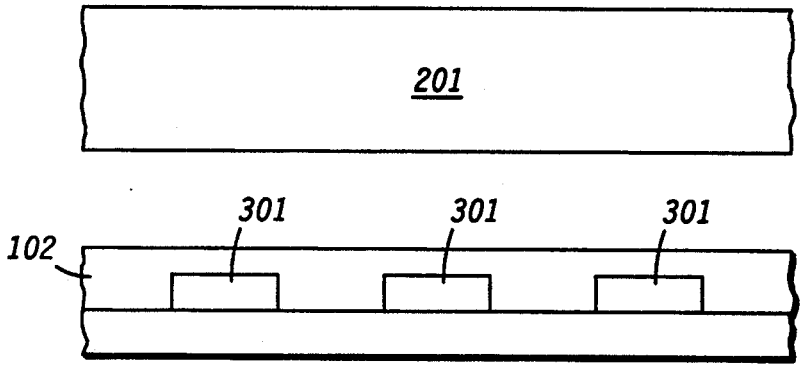

FIG. 3B shows a partial side cross-section of the embodiment shown in FIG. 3A rotated 90 degrees in a plane orthogonal to the plane of the figure. In FIG. 3B the interface layer (102) is shown as being partialy disposed on the plurality of conductive lines (301).

Figure 4A:
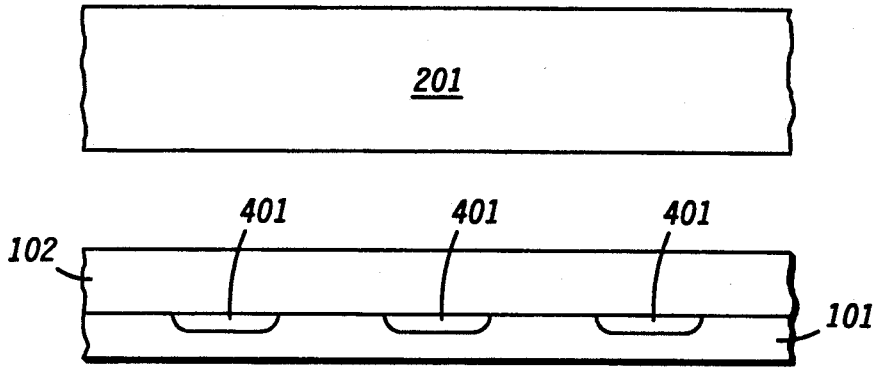
FIG. 4A is a partial side elevation cross-sectional view of a third embodiment of a field emission display in accordance with the present invention.

FIG. 4A shows a partial side cross-sectional depiction of another embodiment of a field emission device (40). A plurality of low resistivity regions (401) that are highly-doped regions in the semiconductor substrate reside in the supporting substrate and traversing the extent of the patterned interface layer (102). At least some of the low resistivity regions (401) described above are operably coupled to at least some of the conductive lines (301) such that the conductive lines (301) do not cross the region of the major surface of the supporting substrate (101) whereon the preferentially patterned interface layer (102) is disposed. When so constructed, at least some of the plurality of conductive lines (301) disposed outside, or external to the evacuated volume defined or enclosed by the cover (201) and the substrate (101) of the field emission display may be operably coupled to at least some of the conductive lines (301) lying within the evacuated volume of the field emission display.

Figure 4B:
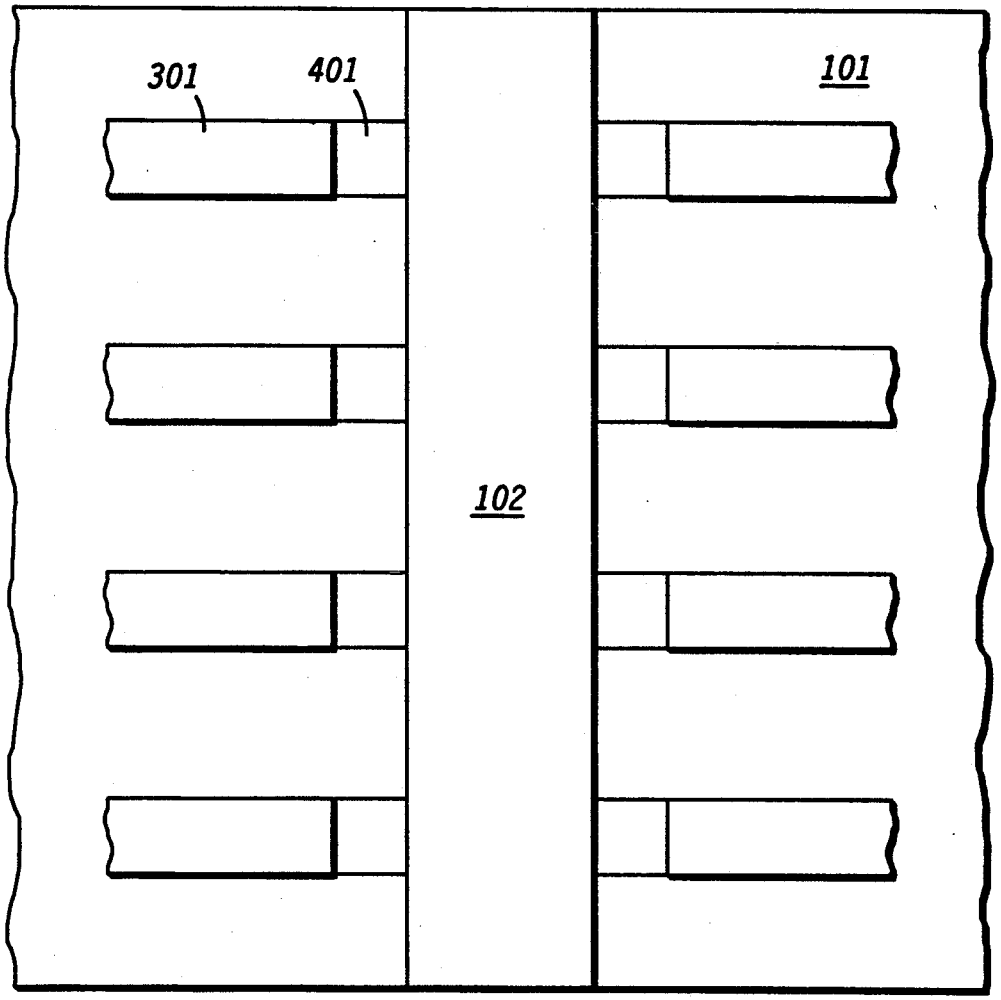
FIG. 4B is a partial top plan view of a third embodiment of a field emission display in accordance with the present invention.

FIG. 4B is a partial top plan view of the embodiment of a field emission display shown in FIG. 4A.

FIG. 4B shows the proximal relationship between the low resistivity regions (401) and the conductive lines (301).

What is claimed is:

1. A field emission display comprised of:

a substrate comprised of semiconductor material and having at least one major surface;

at least one electric field induced electron emission structure substantially disposed on at least a part of the at least one major surface of the substrate;

an interface layer substantially surrounding said at least one electric field induced electron emission structure on the substrate;

a display faceplate cover including a layer of cathodoluminescent material and having a sealing surface substantially conforming to and for mating with the interface layer, the display faceplate cover being distally located with respect to the electric field induced electron emission structure; and a glass frit sealing layer disposed between the interface layer and the sealing surface of the display faceplate cover whereby a display so constructed provides a sealed volume with a pressure within the sealed volume of less than $1\times10^{-6}$ Torr.

2. The field emission display of claim 1 wherein the substrate further includes silicon-based semiconductor material.

3. The field emission display of claim 1 wherein the interface layer is comprised of silicon dioxide-based material.

4. A field emission display comprised of:

a substrate comprised of semiconductor material and having at least one major surface;

an electric field induced electron emission structure disposed on a portion of the at least one major surface of the substrate;

a plurality of substantially parallel conductive lines disposed on a part of the at least one major surface of the substrate;

an interface layer disposed on a part of the at least one major surface of the substrate and partially disposed on at least some of the plurality of conductive lines, said interface layer substantially surrounding said electric field induced electron emission structure;

a display faceplate including a layer of cathodoluminescent material, covering said electric field induced electron emission structure and said plurality of substantially parallel conductive lines, distally located with respect to the electric field induced electron emission structure; and a glass frit seal disposed between interface layer and at least a part of the display faceplate;

whereby a display so constructed provides a sealed volume with a pressure within the sealed volume of less than $1\times10^{-6}$ Torr.

5. The field emission display of claim 4 wherein the substrate is comprised of silicon material.

6. The field emission display of claim 4 wherein the preferentially patterned interface layer is comprised of silicon dioxide material.

7. A field emission display comprising:

a substrate comprised of semiconductor material and having at least one major surface;

an electric field induced electron emission structure substantially disposed on the at least one major surface of the substrate;

a plurality of conductive lines disposed on the at least one major surface of the substrate;

an interface layer at least partially disposed on the at least one major surface of the substrate;

at least one low resistivity region disposed in the substrate proximate to the at least one major surface of the substrate and proximal to the interface layer and operably coupled to at least some of the plurality of conductive lines;

a display faceplate including a layer of cathodoluminescent material, distally located with respect to the electric field induced electron emission structure; and a glass frit substantially disposed in the region between the preferentially patterned interface layer and at least a part of the display faceplate;

whereby a display so constructed provides a sealed volume with a pressure within the sealed volume of less than $1\times10^{-6}$ Torr.

8. The field emission display of claim 7 wherein the supporting substrate is comprised of silicon material.

9. The field emission display of claim 7 wherein the preferentially patterned interface layer is comprised of silicon dioxide material.

* * * * *